US006921512B2

(12) United States Patent
Doty

(10) Patent No.: US 6,921,512 B2
(45) Date of Patent: Jul. 26, 2005

(54) ALUMINUM ALLOY FOR ENGINE BLOCKS

(75) Inventor: Herbert William Doty, Amherst, NH (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/603,086

(22) Filed: Jun. 24, 2003

(65) Prior Publication Data

US 2004/0265163 A1 Dec. 30, 2004

(51) Int. Cl.[7] ..... C22C 21/04
(52) U.S. Cl. ..... 420/534; 420/546; 420/549
(58) Field of Search ..... 420/534, 546, 420/549

(56) References Cited

U.S. PATENT DOCUMENTS

| | | | |
|---|---|---|---|
| 4,434,014 A | 2/1984 | Smith | |
| 5,217,546 A | 6/1993 | Eady et al. | |
| 5,484,492 A | 1/1996 | Rogers et al. | |

FOREIGN PATENT DOCUMENTS

| | | | | |
|---|---|---|---|---|
| JP | 57079140 A | * | 5/1982 | ..... C22C/21/02 |
| JP | 58042748 A | * | 3/1983 | ..... C22C/21/02 |

OTHER PUBLICATIONS

"ASM Handbook: vol. 15 Casting" ASM International, 1988, p 744, 746.*

"ASM Handbook: vol. 15 Casting", ASM International, 1988, p751–752.*

* cited by examiner

*Primary Examiner*—George Wyseomierski
*Assistant Examiner*—Janelle Morillo
(74) *Attorney, Agent, or Firm*—Kathryn A. Marra

(57) ABSTRACT

An aluminum alloy is disclosed that is suitable for casting and machining cylinder blocks for engines, especially gasoline fuel engines for automotive vehicles. The casting has the strength and wear resistance to piston/seal scuffing for such engines. The alloy comprises, by weight, 9.5 to 12.5% silicon, 0.1 to 1.5% iron, 1.5 to 4.5% copper, 0.2 to 3% manganese, 0.1 to 0.6% magnesium, 2.0% max zinc, 0 to 1.5% nickel, 0.25% maximum titanium, up to 0.05% strontium and the balance aluminum, where the weight ratio of manganese to iron is 1.2 to 1.75 or higher when the iron content is equal to or greater than 0.4% and the weight ratio of manganese to iron is at least 0.6 to 1.2 when the iron content is less than 0.4% of the alloy.

4 Claims, 1 Drawing Sheet

ALUMINUM ALLOY FOR ENGINE BLOCKS

TECHNICAL FIELD

This invention pertains to aluminum alloys that can be cast into machinable and wear resistant articles such as engine cylinder blocks for automotive vehicles.

BACKGROUND OF THE INVENTION

The use of aluminum for automotive engine blocks offers the potential for considerable weight savings in vehicles and for improvements in fuel economy. However, after several decades of attempts no aluminum alloy has been developed or identified that provides the required combination of casting, machining and wear resistance properties for cylinder block manufacture and service. Aluminum alloys that have provided resistance to piston wear have been difficult to cast into the intricate shapes of the cylinder blocks and have been difficult to machine to the finish dimensions required. Aluminum alloys that can be suitably cast and machined to make cylinder blocks have lacked cylinder wall wear resistance in service. Engine manufacturers have tended to select castable and machinable alloys and modify the surfaces of the cylinder walls to obtain the necessary wear resistance.

Thus, when current cylinder blocks are cast of alloys such as Aluminum Alloy 319 or AA 356 they require cylinder liners (cast iron, metal matrix composite, AA390) or surface treatment (plating, coating) to provide wear resistance during operation. Cast iron liners have been placed like cores in the casting mold for inclusion in the blocks or inserted in the machined cylinder bores. Other wear resistant liner compositions have also been used. As an alternative to cylinder liners, wear resistant coatings have been applied to the cylinder walls of the cast and machined block. Each of these modifications to the block increases the cost of the product.

There remains a need for an aluminum alloy that provides all of the above properties for cylinder block manufacture and wear properties. It is an object of this invention to provide such material.

SUMMARY OF THE INVENTION

The requirements for an aluminum alloy intended for the mass production of an all-aluminum cylinder block for an automotive engine are very demanding. Such an alloy must simultaneously provide: sufficient resistance to piston/ring wear on the cylinder walls; adequate strength and stiffness in the bulkhead area; pressure tightness between oil/water/combustion passages; elevated temperature strength to maintain bolt torque at moderate and cyclic engine operating temperatures; and dimensional stability. Furthermore, the alloy must have sufficient fluidity in the molten state for the casting of an intricate shape by any casting process of choice and be machinable to close tolerances. The alloy must require minimal specialized equipment or processing and have minimal effects on post casting operations, such as heat-treatment, machining and assembly. It must be insensitive to minor variations in processing. Finally, the long-term impact of use, such as dimensional stability, corrosion, creep and, eventually, recycling should be neutral or enhanced. The aluminum alloy of this invention provides these properties and benefits.

The alloy of this invention comprises, by weight, 9.5 to 12.5 percent silicon, up to 1.5 percent iron, 0 to 1.5 to 4.5 percent copper, 0.2 to 3 percent or more manganese, 0.1 to 0.6 percent magnesium, 0 to 1.5 percent nickel, 0 to 0.03 percent strontium or 0 to 0.02 percent sodium or 0 to 1.2 percent total rare earths, 0.25 percent maximum titanium, less than about 0.5 percent total of other elements and the balance aluminum.

An important feature of the composition is the proportion of manganese content to iron content. Iron is usually present in aluminum alloys. It is a tramp element contained in aluminum produced from bauxite which often contains ferric oxide. Aluminum alloys containing less than 0.4% by weight iron may command a premium price. When the iron content of the alloy is equal to or greater than 0.4%, it is necessary that the weight ratio of manganese to iron be in the range 1.2 to 1.75, and preferably in the range of 1.2 to 1.5. When the iron is present, but in an amount less than 0.4%, the weight ratio of manganese to iron is suitably in the range of 0.6 to 1.2 provided that the manganese content of the aluminum alloy is at least 0.2% by weight. For most casting methods, it is preferred that the iron content not exceed 0.8% by weight of the alloy. However, in die casting the iron content may be as high as 1.5% to prevent the cast metal from sticking to the metal die surface.

Copper and nickel are also elements that affect the manganese content of the alloy. Nickel is not a necessary constituent of the alloy. It is often present in available aluminum alloys and can be tolerated in amounts up to about 2 percent by weight. Similarly, copper is not necessary to the alloy but it does serve as a strengthener. It is easier to cast without porosity in the cylinder block with lower copper content. When the copper content exceeds 1.5% by weight and or the nickel content exceeds 0.75% by weight it is preferred that the manganese content be at least 1.2 to 1.5 times the iron content. Manganese is typically added as a suitable Al—Mn master alloy.

Zinc is often a tramp element and can be tolerated within the specified maximum value. Titanium is often a content of scrap aluminum alloys and reduces grain size when present in the range of 0.04 to 0.25% by weight. Strontium is added to modify the eutectic aluminum-silicon phase to insure no primary silicon phase forms. Alternatively, this eutectic phase can be modified by the addition of sodium or rare earth metals, especially cerium, lanthanum and neodymium, either individually or in combination.

Thus, the subject alloy consists essentially of aluminum, silicon iron, manganese and strontium. A preferred composition, by weight, comprises 11.25 to 11.75% silicon, 0.35 to 0.65% iron (may be higher for die cast block), 1.75 to 2.75% copper, 0.4 to 3% manganese (at least 1.2 to 1.5 times the iron content), 0.15 to 0.3% magnesium, 0.5% maximum zinc, a trace of nickel, 0.01 to 0.03% strontium and the balance aluminum.

The subject alloy provides the fluidity of an aluminum-silicon eutectic alloy. The alloy can be cast into an engine block by any of the common casting methods: die casting (may require higher iron content), permanent mold casting, semi-permanent mold casting, bonded sand casting, lost foam casting and precision sand casting. When the Mn/Fe content is controlled as specified the tensile strength of the cast material is as high as 320 MPa, which is more than 20% greater than the tensile strength of like alloys in which the manganese to iron content is not controlled to such values. Moreover, the cast material is readily machined for finishing of the cylinder block and the material is resistant to piston/ring scuffing and other sources of cylinder block wear.

Other objects and advantages of the invention will become more apparent from the description of a preferred embodiment.

DESCRIPTION OF THE PREFERRED EMBODIMENT

The proposed invention is an aluminum alloy composition which meets the manufacturing and performance conditions stated above for cylinder block castings. The invention is particularly applicable to cylinder block castings for gasoline fueled, reciprocating piston, internal combustion engines. The alloy can be cast by any conventional casting process to produce low porosity, strong, wear resistant engine blocks without special heat treatments and other special processing.

Figure 1:
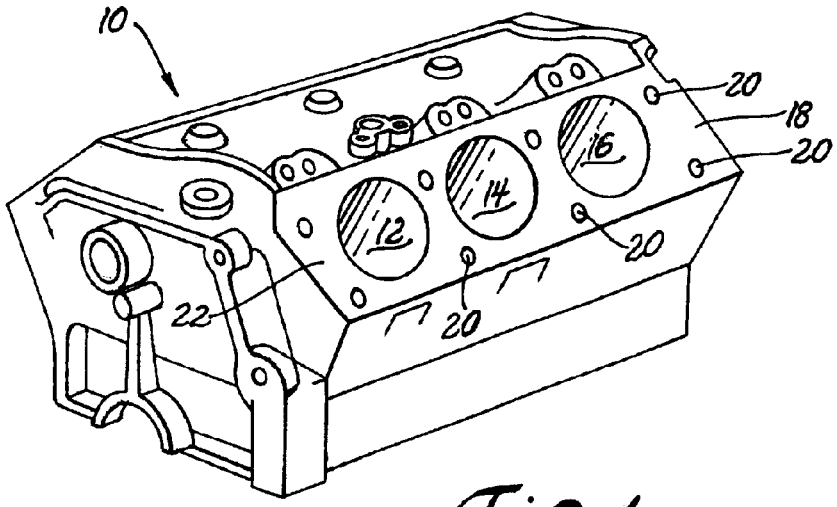
FIG. 1 is an oblique side view of a V-type engine cylinder block, representative of a machinable and wear resistant engine casting producible by the aluminum alloy of this invention.

FIG. 1 illustrates a cylinder block casting 10 of the type that can be cast using the aluminum alloy of this invention. In this example the casting 10 is a V-6 engine block but the subject alloy may used to cast any form of engine cylinder block requiring wear resistance on the cylinder bores and other surfaces of the cast product.

Three cylinders 12, 14 and 16 of one branch 18 of the V are visible in this view of cylinder block casting 10. An aluminum alloy cylinder block casting requires considerable machining. For example, a large number of bolt holes 20 such as for the two cylinder heads, not shown, must be drilled and threaded. The plane bulkhead surface 22 against which the cylinder head lies must be machined. And, of course, walls (bores) of cylinders 12, 14 and 16 must be machine finished. These are but a few of the machining operations required to complete manufacture of a cylinder block casting for assembly into a vehicle engine. The high manganese content, aluminum alloys of this invention are machinable for such an application.

As is known, an engine cylinder block has many intricate sections for coolant and oil flow, and a very fluid and castable alloy is required to fill out the mold cavity during the pouring and solidification of the molten alloy. The alloys of the invention are castable for such intricate products.

The cylinder walls of the reciprocating piston internal combustion engine are subjected to long term abrasion from the reciprocating, motion of the piston and its rings during operation of the vehicle engine. The high manganese to iron, aluminum alloys of this invention provide good wear resistance on such surfaces without the need for special wear resistant liners.

Preparation of the Casting Alloy

A castable melt is prepared by melting aluminum ingot with suitable aluminum based master alloys such as Al-25Fe, Al-50Cu, Al-20Mn, Al-50Si and pure magnesium metal to a desired composition as described in the above summary. Rare earth additions are made via a mischmetal master alloy or as pure metals or as rare earth aluminum master alloys. Such additions can be made to the initial charge. However, it is preferred that they are made after the melt has been treated with a flux and/or degassed, if such processing is used.

The melt is prepared in a suitable furnace such as a coreless induction furnace, electric resistance furnace, reverberatory furnace, or a gas-fired crucible furnace of clay-graphite or silicon carbide. A flux is required only with dirty or drossy charge materials. Usually no special furnace atmosphere is necessary. The heats can be melted in ambient air. Once molten, the melt is degassed using common aluminum foundry practice, such as purging the melt with dry argon or nitrogen through a rotary degasser. The degassing operation can also contain a halogen gas, such as chlorine or fluorine or halogen salts to facilitate impurity removal. Preferably the melt is handled in a quiescent manner so as to minimize turbulence and hydrogen gas pick-up.

Once degassed and cleaned the metal is treated with strontium or a rare-earth mischmetal to affect eutectic silicon modification. The preferred method is to use Al-10Sr or Al-90Sr master alloys, plunged into the metal during the last stages of degassing, provided no halogen material is used. The gas level of the melt is assessed via any of the common commercially available methods, such as the reduced pressure test or an AlSCAN™ instrument.

Finally, just prior to pouring, the melt is grain refined using titanium-boron master alloy, typical addition of about 0.02 to 0.1 weight percent titanium. Some applications may not require grain refining.

Melt superheat has been varied from less than 150° F. to well over 700° F. with success. Cylinder blocks have been cast from the subject alloys at melt temperatures from 1170° F. to 1500° F. Casting melt temperatures of about 1170° F. to 1200° F. are preferred. Lower levels of superheat are recommended to minimize micro-porosity. However, higher levels of superheat have resulted in a refinement of the intermetallics in the microstructure, so under some circumstances this method may be preferred.

The metal is poured into a suitable mold that has been made by any of a number of known mold making practices, such as bonded sand molds, metal or permanent molds or investment mold making. Sand molds can contain metal chills to facilitate directional solidification or to refine the microstructure in certain critical areas of the casting. The metal is allowed to solidify in the mold and then the mold is opened to remove the casting. In the case of sand molds, excess sand is removed from the casting by shot blasting. Gating portions of the casting are removed.

Castings can be evaluated by commonly used nondestructive tests, such as X-ray inspection, dye penetrant inspection or ultrasonic inspection. These tests are typically conducted to determine whether the casting has formed porosity due to shrinkage during solidification. Such shrinkage can be due to the composition of the cast alloy and/or to the shape of the casting. Engine blocks cast by the subject alloys do not typically have shrinkage problems due to the composition of the alloy.

Engine block castings of the aluminum alloys of this invention can be heat treated to enhance the mechanical properties by known precipitation hardening mechanisms for aluminum alloys. For example, a T5 temper consists of artificially aging the casting at an intermediate temperature, typically from 300 to 450° F., for up to 12 hours or more. More demanding casting applications may require the peak strength T6 temper which consists of a solution treatment at a temperature near, but less than the alloy solidus temperature, for times typically ranging from 4 to 12 hours, but could be more or less depending on the initial stage of the microstructure in the casting. The casting is quenched from the solution temperature in a suitable quenchant fluid such as water, oil or polymer, or rapidly moving air. Such quenching rapidly cools the heat treated casting through the critical temperature regime, usually 850° F. to 450° F. Once cooled, the casting usually resides at room temperature for 1 hour to 24 hours and is then reheated to an intermediate temperature, similar to the T5 temper. In applications where dimensional stability is of utmost importance, the T7 temper will be specified. This is similar to the T6 temper, except that the artificial aging cycle is either done at higher temperatures or longer times or both to achieve a somewhat softer condition, but with greater dimensional stability.

The engine block casting is now ready to be machined to the finish dimensions of the complicated block structure. Such machining includes a substantial amount of drilling, honing and the like in order to complete the block for engine assembly. Thus the machinability of the cast material is critical to its utility for engine block applications. Further, in the case of engine blocks cast for testing or alloy evaluation purposes the block is now ready for test specimens to be machined from it.

For mechanical property and physical property testing, test coupons are suitably sectioned from the crankshaft bearing journal and from head bolt bosses of cylinder blocks and then machined into the test specimen geometry for testing. Other test applications may require a special test casting geometry, such as ribbed plate castings for machinability testing. These castings are milled flat so that drilling and tapping test can be run independent of the casting surface condition to determine just the effect of the new alloy on tool wear rates.

Specific Examples of Engine Block Castings and Comparative Evaluation of Alloys

A series of V-8 cylinder blocks for 4.3 liter displacement, gasoline fueled engines were gravity cast into bonded sand molds. Some of the molds had chill blocks to form the portion of the cavity defining the crankshaft bearing journal portion of the casting. The remaining surfaces of such "chilled" engine block castings were formed by the bonded sand portions of the mold.

Some of the castings were cast using a specific compositional embodiment of the alloy of this invention. The composition, by weight, was 10.7 percent silicon, 0.37 percent iron, 0.72 percent manganese, 1.0 percent copper, 0.42 percent magnesium and the balance substantially all aluminum except for incidental impurities. Importantly, the weight ratio of manganese to iron in this alloy is 1.94.

For purposes of comparison of cast properties the same engine block shapes were also chill cast using commercial alloys AA319 and AA356 which are presently used for such engine castings. The AA319 composition, by weight, was 6.5 percent silicon, 0.8 iron, 0.5 manganese, 3.5 percent copper, 0.4 percent magnesium, 3.0 percent zinc, 0.25 percent titanium and the balance aluminum. The AA356 composition by weight was 7.0 percent silicon, 0.2 percent iron, 0.1 percent manganese, 0.20 percent copper, 0.2 percent magnesium, 0.05 percent zinc, 0.20 percent titanium and the balance aluminum. Both the AA319 and AA356 alloys are used for the casting of engine blocks. They have suitable fluidity for the casting of such intricate structures with the closely spaced cylinders and cooling passages. And castings of these commercial alloys can be rapidly machined without unacceptable tool wear. However, such castings are susceptible to excessive wear from the pistons and piston rings that reciprocate in sealed and sliding engagement within their cylinder bores. These iron liners or other wear resistant lining materials must be located within the cylinders of castings of AA319 and 356 compositions. The making and placing of such liners adds substantially to the cost of engines using cast blocks of these commercial alloys.

Each melt was prepared to its specified composition under suitable practices for the alloy. The melt of the subject high Mn/Fe alloy was held at a temperature of 1200° F. and treated. The castings were poured and allowed to cool and solidify. The castings were removed from the sand molds and heat treated and aged to a T6 temper condition. Tensile and fatigue test specimens were removed from head bolt boss surfaces (an unchilled region of the casting for average properties) of the cast engine cylinder blocks. Tensile yield strength (Ys) values and ultimate tensile strength (UTS) values of the specimens machined from the cast blocks of the subject alloy were comparable to Ys and UTS values obtained on AA319 and 356 engine block castings. More importantly, the cast alloys of this invention display yield strength, ultimate tensile strength, elongation in yield and fatigue strength values suitable for engine cylinder block applications. Furthermore, engine block castings of the aluminum alloy compositions of this invention are suitably machinable for engine block manufacture. The castings have low porosity levels, typically under one percent by volume. And, surprisingly, the alloys of this invention display suitable wear resistance and durability during engine operation so that separate cylinder liners are not required.

Twenty hour, high speed bench tests (Cameron-Plint) were conducted on sections taken from prepared cylinder bores including a bore (without an iron liner) from an AA319 cylinder block, an AA319 cylinder block with an iron liner, an AA319 cylinder block with a commercial hypereutectic Al—Si liner and a cylinder block of the subject high Mn/Fe aluminum alloy. A section of a production piston ring was run against each cylinder block section under controlled temperature and lubrication conditions in the commercial Cameron-Plint test equipment. The test was run under high load conditions to get accelerated wear in the twenty hour period. The test conducted in these experiments has been calibrated against running engines with various cylinder bore materials and wear rates. It has been determined that when a test wear scar volume is less than 0.5 cubic millimeters an engine of such cylinder bore material will engine durability tests as a qualifier for commercial use.

At the conclusion of the 20 hour runs the respective bore sections were analyzed and the wear volume in cubic millimeters of the scaring of the cylinder walls were carefully measured. The subject alloy displayed much less scar volume (0.25 to 0.5 $mm^3$) in these tests than the bare AA319 block (0.8 to 1.3 $mm^3$) and comparable wear to the hypereutectic Al—Si liners (0.28 to 0.5 $mm^3$). The engine blocks of this invention displayed slightly more wear than the engines with the conventional iron liners (about 0.1 $mm^3$). Of course, the subject aluminum alloy blocks retain the advantage of the thermal conductivity of aluminum alloy bores and the cost advantage of the liner less aluminum alloy.

The Manganese to Iron Weight Ratio

An important feature of the practice of this invention is the control of the weight ratio of manganese to iron in the aluminum alloy composition. Attention to the manganese content is important in the aluminum alloys of this invention because of the usual presence of iron, copper and/or nickel. As stated above, iron and nickel are often present in aluminum alloys and copper is often added as a strengthening element. In general, when the iron content of this aluminum alloy is 0.4% by weight or higher it is preferred that the manganese is incorporated in the alloy in an amount that is at least 1.2 to 1.5 times the weight of the iron. It is realized, of course, that the atomic weights of manganese (54.938) and iron (55.847) are quite close and, thus, the required weight ratio is close to an atomic ratio. The high manganese content is also important, even with relatively low iron content, when the nickel is present and/or copper has been added.

The high manganese content contributes to the strength of the alloy. The manganese content also contributes to the wear resistance of this castable alloy which is of critical importance in the cylinder bore regions of the cylinder block. It is believed that the abundance of manganese atoms in the alloy contributes to the strengthening and hardening of the microstructure.

Figure 2:
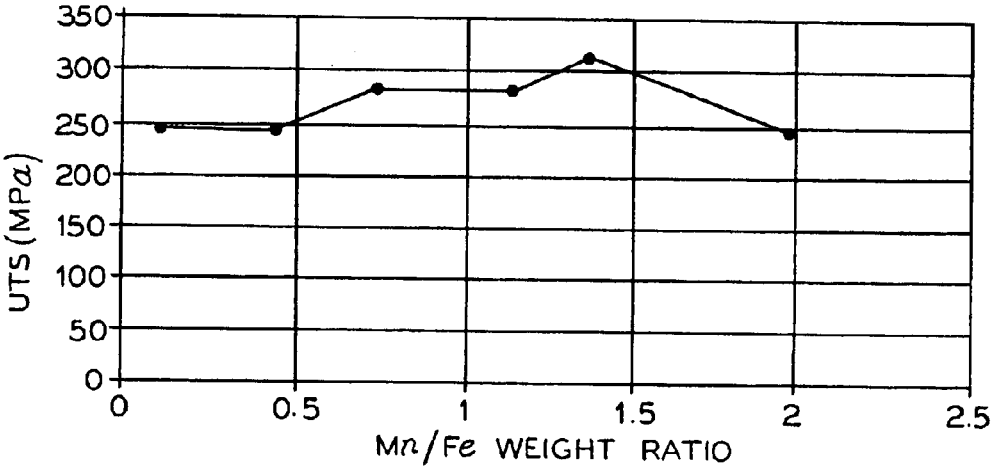
FIG. 2 is a graph of ultimate tensile strength, UTS (MPa), values measured on cast specimens of an aluminum alloy of this invention with manganese content increasing as indicated by the Mn/Fe weight ratio on the abscissa.

FIG. 2 is a graph illustrating the effect of increasing manganese content, expressed as manganese to iron weight ratio, on the ultimate tensile strength in mega Pascals (UTS in MPa) of an aluminum alloy representative of this invention. The content of the alloy, in weight percent, was 11.75 percent silicon, 0.4 percent iron, 2.1 percent copper, 0.22 percent magnesium, 0.03 percent strontium and the balance aluminum except for the manganese content. A series of castings were made with the manganese increasing from a weight ratio of 0.1 of the iron content to 2 times the iron content as indicated by the data points in FIG. 1. The castings were cleaned, heat treated to a T6 temper level and tensile test specimens machined from them.

FIG. 2 is a graph of UTS (MPa) values measured on cast specimens of the aluminum alloy with manganese content increasing as indicated by the Mn/Fe weight ratio on the abscissa. It is seen in the data for this exemplary alloy that the UTS increases as the manganese content increases. In the case of this particular alloy and heat treatment, a maximum value of UTS of about 310 MPa was obtained at a Mn/Fe ratio of about 1.3 for this alloy. As stated the wear resistance of aluminum cylinder blocks produced in accordance with the high Mn/Fe ratios of this invention is suitable for engine operation without the use of iron cylinder liners or the like.

This invention has been described in terms of certain specific embodiments. However, other embodiments could readily be adapted by one skilled in the art. The scope of the invention is intended to be limited only by the following claims.

What is claimed is:

1. An aluminum alloy for a cast engine block, said alloy consisting essentially of, by weight, 11.25 to 11.75% silicon, 0.35 to 0.65% iron, 1.75 to 2.75% copper, 0.4 to 1.2% manganese, 0.15 to 0.3% magnesium, 0.5% max zinc, a trace of nickel, 0.2% maximum titanium, 0.01% to 0.03% strontium and the balance aluminum, where the weight ratio of manganese to iron is at least 1.2 to 1.75.

2. A cast cylinder block for an internal combustion engine when formed of the alloy recited in claim 1.

3. An aluminum casting alloy consisting essentially of, by weight, 11.25 to 11.75% silicon, 0.35 to 0.65% iron, 1.75 to 2.75% copper, 0.4 to 1.2% manganese, 0.15 to 0.3% magnesium, 0.5% max zinc, a trace of nickel, 0.2% maximum titanium, 0.01% to 0.03% strontium, and aluminum, where the weight ratio of manganese to iron is at least 1.2 when the iron content is equal to or greater than 0.4% and the weight ratio of manganese to iron is at least 0.6 when the iron content is less than 0.4% of the alloy.

4. An aluminum casting alloy as recited in claim 3, said alloy consisting essentially of, by weight, 11.25 to 11.75% silicon, 0.35 to 0.65% iron, 1.75 to 2.75% copper, 0.4 to 1.2% manganese, 0.15 to 0.3% magnesium, 0.5% max zinc, a trace of nickel, 0.2% maximum titanium, 0.01% to 0.03% strontium, and aluminum, where the weight ratio of manganese to iron is at least 1.2 when the iron content is equal to or greater than 0.4% and the weight ratio of manganese to iron is at least 0.6 when the iron content is less than 0.4% of the alloy, and the microstructure of the cast alloy is substantially free of primary silicon.

* * * * *